US005866068A

United States Patent [19]

Takahashi

[11] Patent Number: 5,866,068

[45] Date of Patent: Feb. 2, 1999

[54] HEAT-RESISTANT ALLOY

[75] Inventor: Makoto Takahashi, Hirakata, Japan

[73] Assignee: Kubota Corporation, Osaka, Japan

[21] Appl. No.: 835,356

[22] Filed: Apr. 7, 1997

Related U.S. Application Data

[63] Continuation of Ser. No. 579,766, Dec. 28, 1995, abandoned.

[30] Foreign Application Priority Data

Sep. 29, 1995 [JP] Japan ..... 7-252617

[51] Int. Cl.[6] ..... C22C 30/00

[52] U.S. Cl. ..... 420/428; 420/451; 420/584.1; 420/586; 420/588

[58] Field of Search ..... 420/451, 584.1, 420/586, 588, 428; 148/407, 410, 419, 423, 427, 442

[56] References Cited

U.S. PATENT DOCUMENTS 5,103,870 4/1992 Ishii et al. .

FOREIGN PATENT DOCUMENTS 39 21 175 1/1990 Germany .
49-098719 9/1974 Japan .
5-093240 4/1993 Japan .
7-166290 6/1995 Japan .
7-258780 10/1995 Japan .
7-258782 10/1995 Japan .
7-258783 10/1995 Japan .
2 193 726 2/1988 United Kingdom .

OTHER PUBLICATIONS

Sugitani et al., Patent Abstracts of Japan, Vol. 017, No. 426, Application No. 03280672, published Apr. 16, 1993.
Makoto et al., Patent Abstracts of Japan, for Application No. 03183014, published Jan. 14, 1993.
Makoto et al., Patent Abstracts of Japan, for Application No. 01206730, published Jan. 10, 1992.
Teruo et al., Patent Abstracts of Japan, for Application No. 02036762, published Oct. 28, 1991.

*Primary Examiner*—Margery Phipps
*Attorney, Agent, or Firm*—Armstrong, Westerman, Hattori, McLeland & Naughton

[57] ABSTRACT

A heat-resistant alloy suitable as a material for reactor tubes such as cracking tubes for producing ethylene in the petrochemical industry consisting essentially of, in % by weight, 0.1 to 0.5% of C, over 0% to not more than 4% of Si, over 0% to not more than 3% of Mn, over 40% to not more than 50% of Cr, over 0% to not more than 10% of Fe, 0.01 to 0.6% of Ti, 0.01 to 0.2% of Zr, at least one element selected from the group consisting of 0.5 to 5% of W, 0.3 to 2% of Nb and 0.5 to 3% of Mo, and the balance substantially Ni. The alloy is excellent in oxidation resistance, high-temperature creep rupture strength, carburization resistance and ductility after aging.

3 Claims, No Drawings

HEAT-RESISTANT ALLOY

This application is a continuation of application Ser. No. 08/579,766 filed Dec. 28, 1995, now abandoned.

FIELD OF THE INVENTION

The present invention relates to heat-resistant alloys useful as materials for forming, for example, reactor tubes for thermally cracking hydrocarbons in the petrochemical industry.

BACKGROUND OF THE INVENTION

The tubes for thermally cracking hydrocarbons, for example, those for producing ethylene by thermally cracking naphtha or the like under the conditions of high temperature and high pressure (about 800° to about 1100° C. in temperature and up to about 5 kg/cm$^2$ in pressure) while passing the material through the tube must have high resistance to oxidation and mechanical strength (especially creep rupture strength) at high temperatures. The cracking tube must be outstanding also in resistance to carburization because solid carbon separates out from the reaction system during operation and causes carburization by adhering to the inner surface of the tube wall and diffusing through the tube wall to deteriorate the tube material and thereby embrittle the tube.

Such reactor tubes are usually prepared from HP material (0.4C-1.75Si-25Cr-35Ni-Fe) according to ASTM standard, improved HP material (0.4C-1.75Si-25Cr-35Ni-Mo, Nb, W-Fe), etc.

From the viewpoint of improved operation efficiency and productivity, it has recently been required to conduct the thermal cracking reaction of hydrocarbons at about 1150° C. or higher temperatures.

However, the conventional tube materials, although usable at temperatures of about 1100° C. to about 1150° C., encounter difficulty in ensuring the safety of operation at higher temperatures, rapidly deteriorating especially owing to insufficient carburization resistance to become shortened in service life.

Cracking tubes locally degraded as by carburization are repaired usually by removing the degraded portion and welding for replacement. However, if the tube has been markedly impaired in ductility after aging, the tube is liable to weld cracking due to the embrittlement of the tube material when repaired by welding. For this reason, the reactor tube material needs to have high ductility after aging.

Thus, the reactor tube material is not suitable if low in one of the foregoing characteristics, i.e., oxidation resistance, creep rupture strength at high temperatures, carburization resistance and ductility after aging.

In view of the above problem, the present invention provides a heat-resistance alloy which is outstanding in oxidation resistance, creep rupture strength at high temperatures, carburization resistance and ductility after aging for use as a tube material which is least likely to embrittle so as to ensure durability and safety of operation.

SUMMARY OF THE INVENTION

The present invention provides a heat-resistant alloy comprising, in % by weight, 0.1 to 0.5% of C, over 0% to not more than 4% of Si, over 0% to not more than 3% of Mn, over 40% to not more than 50% of Cr, over 0% to not more than 10% of Fe, 0.01 to 0.6% of Ti, 0.01 to 0.2% of Zr, at least one element selected from the group consisting of 0.5 to 5% of W, 0.3 to 2% of Nb and 0.5 to 3% of Mo, and the balance substantially Ni.

DETAILED DESCRIPTION OF THE INVENTION

Given below are the reasons for limiting the components of the heat-resistant alloy of the invention. C: 0.1–0.5%

C is an essential element for giving improved castability to the alloy and ensuring the quality of tubes prepared as by centrifugal casting. The element is present in the form of a solid solution in the austenitic base structure of the alloy, contributing to an improvement in high-temperature strength, especially in creep rupture strength. Accordingly, at least 0.1% of C should be present. On the other hand, presence of a large amount of C hardens and embrittles the alloy, so that the upper limit should be 0.5%. Si: over 0% to not more than 4%

Si is effective for deoxidizing the melt to be made into the alloy and improving the flowability of the melt. Si further forms on the alloy surface an oxide film serving as a barrier against the diffusion and penetration of C, contributing to an improvement in carburization resistance. These effects increase with an increase in the amount of Si. The amount is preferably at least 2%. If the amount exceeds 4%, however, difficulty is encountered in ensuring weldability required of the alloy as a structural material. The upper limit should be 4%, therefore. Mn: over 0% to not more than 3%

Mn serves as an deoxidizer for the molten mixture to be made into the alloy. S present in the alloy as an impurity is further fixed as MnS and rendered harmless, whereby the alloy is given improved weldability. These effects are fully available when up to 3% of Mn is present. An excess of Mn, if present, fails to achieve a corresponding result. Accordingly, the upper limit should be 3%.

Cr: over 40% to not more than 50%.

Cr is an important element for enhancing the oxidation resistance and high-temperature strength required of the heat-resistant alloy. In addition to these characteristics, we have found that the Cr oxide film formed over the alloy surface functions as an excellent barrier against the diffusion and penetration of C in high-temperature carburizing environments, Cr thus exhibiting an outstanding effect to give improved carburization resistance. To fully assure this carburization resistance improving effect, over 40% of Cr is incorporated in the alloy of the invention. However, the upper limit should be 50% because presence of more than 50% of Cr results in a marked tendency for the ductility to reduce during use at a high temperature. Fe: over 0% to not more than 10%

Presence of a large amount of Fe results in impaired oxidation resistance. The alloy can be free from the objectionable result when containing up to 10% of Fe. Ti: 0.01–0.6%

Ti contributes to an improvement in high-temperature creep rupture strength by inhibiting the growth of secondary chrominum carbides into coarser particles in the alloy in high-temperature environments. This effect is available when at least 0.01% of Ti is present and increases with increasing Ti content. If the content exceeds 0.6%, however, the effect nearly levels off, and reduced creep rupture strength will conversely result, so that the upper limit should be 0.6%. Preferably, the Ti content is 0.05 to 0.4%. Zr: 0.01–0.2%

Zr is an important element which produces a solid-solution strengthening effect on the alloy base to give enhanced creep rupture strength at high temperatures. This effect is available when at least 0.01% of Zr is present, and the creep rupture strength increases with increasing Zr content. However, we have found that if the content exceeds 0.2%, lower ductility will result after aging despite an improvement in creep rupture strength. For this reason, the Zr content should be in the range of 0.01 to 0.2%. When the ductility after aging is considered to be of special importance, the content is more preferably less than 0.05%.

The heat-resistant alloy of the present invention further comprises at least one element selected from the group consisting of W, Nb and Mo, in addition to the foregoing elements. W: 0.5–5%

W forms a substitutional solid solution in the austenitic base structure and partly precipitates at the grain boundaries. The element enhances the strength of the alloy at high temperatures, especially the creep rupture strength, by its solid-solution strengthening effect and precipitation strengthening effect. Preferably, W should be present in an amount of at least 0.5% to exhibit these effects. With an increase in the amount, the effects increase, but the ductility after aging becomes impaired, so that the upper limit should be 5%. More preferably, the W content is 1 to 3%. Nb: 0.3–2%

Nb forms carbides such as NbC and double carbides such as (Nb,Ti)C during the solidification of the alloy as cast, precipitating at the grain boundaries to give increased intergranular fracture resistance to high-temperature creep and enhanced creep rupture strength. This effect is available when at least 0.3% of Nb is present and increases with increasing Nb content, whereas contents in excess of 2% result in lower creep rupture strength and impaired oxidation resistance. Accordingly, the upper limit should be 2%. Preferably, the content is 0.3 to 1.7%. Mo: 0.5–3%

Mo affords improved creep rupture strength at high temperatures by a solid-solution strengthening effect on the austenitic base structure and a grain boundary strengthening effect due to formation of Cr-Mo carbides. These effects are available when at least 0.5% of Mo is present and increase with an increase in the Mo content, whereas presence of more than 3% of Mo conversely results in impaired creep rupture strength. The upper limit should therefore be 3%. Ni: balance component Ni is the main-component element for forming the austenitic base structure of the present alloy and is required for ensuring oxidation resistance at high temperatures and carburization resistance. Ni, which is the balance component of the invention, is incorporated preferably in an amount of 44 to 50%.

The presence of P, S and other impurities is permissible in such amounts that these impurities become inevitably incorporated into the alloy by usual alloy forming techniques involving melting. For example, up to 0.04% of P and up to 0.04% of S, if present, will not impair the characteristics of the alloy of the present invention.

Members, such as cracking tubes and like reactor tubes, of heat-resistant alloy of the invention are produced by centrifugal casting. The tube for use as a reactor tube need not always be entirely prepared from the heat-resistant alloy of the invention, but the wall thickness of the tube can be of two-layer structure comprising an inside layer for which only the heat-resistant alloy of the invention is used and which is given the required carburization resistance, and an outside layer prepared from other heat-resistant alloy (known alloy such as HP40 material or an improvement thereof). The two-layer tube can be produced by a centrifugal casting process comprising two steps, i.e., forming the outside layer by casting a melt of suitable heat-resistant alloy and subsequently forming the inside layer by casting the heat-resistant alloy of the invention as melted.

EXAMPLES

Sample tubes (138 mm in outside diameter, 20 mm in wall thickness, 570 mm in length) each in the form of a hollow cylinder were produced by centrifugal casting from molten mixtures of alloy components prepared by a high-frequency induction melting furnace. Test pieces were prepared from each sample tube and subjected to the following tests.

Carburization Test (1) Size of test piece 25 mm in width, 10 mm in thickness, 70 mm in length.

(2) Test method

The test piece was buried in a solid carburizing agent (Degussa KG30), heated to 850° C., further heated from this temperature to 1200° C. over a period of 30 hours, held at the same temperature for 20 hours and thereafter cooled. The test piece was then held heated at 1100° C. (in usual atmosphere) for 5 hours. The test piece was repeatedly subjected to this cycle of carburization treatment and oxidation treatment (cyclic carburization test). The carburization treatment time was 200 hours in total, and the oxidation treatment time was 15 hours in total.

(3) Measurement of amount of carburization

After the cyclic carburization test, cut particles were collected from the test piece at each of three positions depthwise from its surface (0.25 mm, 1.25 mm and 2.75 mm from the surface) and chemically analyzed to measure the amount of C. The increase in the amount of C (ΔC %) due to the carburization was calculated by subtracting the amount of C before testing from the measurement.

Creep Rupture Test

The test piece was tested by the method of JIS G 2272 to determine the creep rupture time (hr).

Test piece: 5 mm in the diameter of parallel portion

Test conditions: 1150° C. in temperature, 10.8 MPa in tensile stress

Oxidation Test (1) Test piece 15 mm in width, 5 mm in thickness, 25 mm in length (The surface was polished with #400 sandpaper.)

(2) Test method

The test piece was held in a heating furnace (usual air atmosphere, 1150° C.) for 50 hours, and the furnace was thereafter cooled. This heating cycle was repeated 4 times. The oxidation time was 200 hours in total.

After the test, scale was removed from the surface of the test piece, and the test piece was checked for weight to determine the resulting oxidation loss ($g/cm^2$). Three test pieces were used to obtain an average value.

Room-Temperature Tensile Elongation Test After Aging

The test piece was aged at 1100° C. for 3000 hours, then subjected to a tensile test at room temperature and checked for elongation (%).

The test piece used was 8 mm in the parallel portion and 40 mm in the distance between the gauge marks (gauge length).

Table 1 shows the chemical components of alloys of the samples, and Table 2 the test results. Samples No. 1 to No. 9 are examples of the invention, Sample No. 10 is a comparative example wherein the Zr content is outside the range of the invention, and Samples No. 11 and No. 12 are conventional examples (corresponding to HP materials).

TABLE 1

| | Chemical Composition of Alloy (wt. %) | | | | | | | | | | | | |
|---|---|---|---|---|---|---|---|---|---|---|---|---|---|
| No. | C | Si | Mn | P | S | Cr | Ni | Fe | Ti | Zr | W | Nb | Mo |
| 1 | 0.30 | 2.28 | 0.39 | 0.005 | 0.003 | 41.40 | Bal. | 6.5 | 0.21 | 0.01 | 1.44 | — | — |
| 2 | 0.32 | 2.26 | 0.37 | 0.005 | 0.004 | 41.61 | Bal. | 5.4 | 0.17 | 0.03 | 1.48 | — | — |
| 3 | 0.28 | 2.31 | 0.37 | 0.004 | 0.004 | 40.96 | Bal. | 6.3 | 0.20 | 0.09 | 1.40 | — | — |
| 4 | 0.32 | 2.23 | 0.42 | 0.005 | 0.003 | 41.63 | Bal. | 6.6 | 0.25 | 0.04 | — | 0.96 | — |
| 5 | 0.31 | 2.27 | 0.45 | 0.005 | 0.004 | 41.34 | Bal. | 6.2 | 0.22 | 0.12 | — | — | 1.22 |
| 6 | 0.31 | 2.24 | 0.38 | 0.005 | 0.004 | 41.20 | Bal. | 5.4 | 0.23 | 0.04 | 1.36 | 1.11 | — |
| 7 | 0.29 | 2.19 | 0.43 | 0.005 | 0.004 | 41.41 | Bal. | 5.9 | 0.17 | 0.04 | 1.43 | — | 1.19 |
| 8 | 0.31 | 2.28 | 0.44 | 0.004 | 0.004 | 41.19 | Bal. | 5.8 | 0.19 | 0.08 | — | 0.97 | 1.25 |
| 9 | 0.30 | 2.21 | 0.40 | 0.005 | 0.004 | 40.88 | Bal. | 6.1 | 0.18 | 0.02 | 1.40 | 1.06 | 1.18 |
| 10 | 0.33 | 2.15 | 0.43 | 0.004 | 0.004 | 40.77 | Bal. | 7.7 | 0.27 | 0.25 | 1.50 | — | — |
| 11 | 0.45 | 1.66 | 1.44 | 0.012 | 0.013 | 24.62 | 34.91 | Bai. | — | — | 1.02 | 1.20 | 0.45 |
| 12 | 0.46 | 1.60 | 0.91 | 0.015 | 0.015 | 25.56 | 35.49 | Bal. | — | — | — | 0.81 | — |

TABLE 2

| | Increase in Carbon due to Carburization | | | High-temp. Creep Rupture | Oxidation Loss | Elongation after Aging |
|---|---|---|---|---|---|---|
| No. | 0.25 mm | 1.25 mm | 2.75 mm | Time (Hrs) | ($g/cm^2$) | (%) |
| 1 | 1.23 | 0.43 | 0.00 | 179 | 0.015 | 4.6 |
| 2 | 1.31 | 0.41 | 0.01 | 193 | 0.015 | 5.0 |
| 3 | 1.20 | 0.37 | 0.01 | 170 | 0.014 | 4.0 |
| 4 | 1.20 | 0.38 | 0.00 | 186 | 0.020 | 4.7 |
| 5 | 1.17 | 0.36 | 0.00 | 200 | 0.017 | 3.8 |
| 6 | 1.27 | 0.42 | 0.00 | 181 | 0.019 | 4.4 |
| 7 | 1.27 | 0.42 | 0.01 | 173 | 0.016 | 4.3 |
| 8 | 1.18 | 0.37 | 0.00 | 195 | 0.020 | 4.0 |
| 9 | 1.24 | 0.40 | 0.00 | 164 | 0.020 | 4.5 |
| 10 | 1.36 | 0.51 | 0.02 | 253 | 0.018 | 1.8 |
| 11 | 2.95 | 2.35 | 1.63 | 85 | 0.030 | 4.8 |
| 12 | 3.10 | 2.58 | 1.75 | 71 | 0.033 | 6.0 |

Tables 1 and 2 reveal that as compared with the conventional examples, Samples No. 11 and No. 12, the examples of the invention are smaller in the increase in the amount of C at the different positions depthwise from the test piece surface (higher in carburization resistance), longer in the length of time free of creep rupture (higher in creep rupture strength at high temperatures) and lesser in oxidation loss (higher in oxidation resistance). Sample No. 10 is comparable to the samples of the invention in carburization resistance and oxidation resistance, is superior thereto in creep rupture strength, but is smaller in the elongation after aging and therefore lower in the ductility after aging.

The heat-resistant alloys of the present invention are excellent in all the characteristics of oxidation resistance, high-temperature creep rupture strength, carburization resistance and ductility after aging.

The inner surface of the reactor tube is repeatedly exposed to a reducing atmosphere during high-temperature operation and an oxidizing atmosphere during decoking work (work for removing carbon deposit from the tube inner wall with periodic cessation of operation) and also to heat cycles due to the repetition. The reactor tube prepared from the heat-resistant alloy of the present invention exhibits outstanding creep rupture strength during the high-temperature operation, remains free of deterioration (degradation, cracking or separation) in the oxide film over the tube wall surface despite changes in the interior atmosphere of the tube and the effect of heat cycles, and permits the oxide film to serve as a stable barrier for inhibiting or preventing the diffusion or penetration of carbon in environments of high temperatures in excess of about 1150° C. so as to protect the body of the tube from oxidation and carburization over a long period of time.

The heat-resistant alloy of the invention is excellent in ductility after aging, so that the reactor tube has the advantage of being resistant to cracking when repaired by welding.

Thus, the heat-resistant alloy of the present invention is well-suited as a material for reactor tubes for hydrocarbons, giving improved durability to the reactor tube and assuring a trouble-free smooth operation.

The heat-resistant alloy of the invention is not limited to the above use but is useful also as a material for internal hearth rolls of furnaces for heat-treating steel materials and for radiant tubes.

What is claimed is:

1. A heat-resistant alloy consisting essentially of, in % by weight, 0.1% to 0.5% of C, over 0% to not more than 4% of Si, over 0% to not more than 3% of Mn, 40.88% to not more than 50% of Cr, over 0% to not more than 10% of Fe, 0.01% to 0.6% of Ti, 0.01% to less than 0.05% of Zr, at least one element selected from the group consisting of 0.5% to 5% of W, 0.3% to 2% of Nb and 0.5% to 3% of Mo, and the balance substantially Ni, wherein the amount of Ni is at least 44%.

2. A heat-resistant alloy consisting essentially of, in % by weight, 0.1% to 0.5% of C, over 0% to not more than 4% of Si, over 0% to not more than 3% of Mn, 40.88% to not more than 50% of Cr, over 0% to not more than 10% of Fe, 0.01% to 0.6% of Ti, 0.01% to less than 0.05% of Zr, at least one element selected from the group consisting of 0.5% to 5% of W, 0.3% to 2% of Nb and 0.5% to 3% of Mo, and the balance substantially Ni, wherein the amount of Ni is at least 44%, said alloy being characterized by:

(i) 1.31% or less in increased amount of carbon due to carburization, at a position of 0.25 mm depthwise from a test piece surface, when the test piece is subjected to repeated cycles of carburization treatment and then oxidation treatment, said carburization treatment of each cycle being carried out in such a manner that the test piece is buried in a solid carburizing agent, heated to 850° C., further heated to 1200° C. over a period of 30 hours, held at 1200° C. for 20 hours and thereafter cooled, said oxidation treatment of each cycle being carried out in such a manner that the test piece is heated and held at 1100° C. in normal atmosphere for 5 hours, said carburization treatment being carried out for 200 hours in total and said oxidation test being carried out for 15 hours in total;

(ii) 164 hours or longer in creep rupture time, when a test piece having 5 mm in diameter of parallel portion is subjected to a creep rupture test, at a temperature of 1150° C. and a tensile stress of 10.8 MPa;

(iii) 0.02 g/cm$^2$ or less in oxidation loss, when a test piece having 15 mm in width, 5 mm in thickness and 25 mm in length is subjected to a repeated cycle of oxidation treatment, said oxidation treatment of each cycle being carried out in such a manner that the test piece is heated and held at 1150° C. in normal atmosphere for 50 hours and then cooled to ambient temperature, said oxidation treatment being carried out for 200 hours in total; and (iv) 4.3% or more in elongation, when a test piece having 8 mm in parallel portion and 40 mm in distance between gauge marks is subjected to a tensile elongation test at ambient temperature, after aging the test piece at 1100° C. for 3000° hours.

3. The heat-resistant alloy as defined in claim 2, wherein the amount of Zr is 0.01% to 0.04%.

* * * * *